US006843032B2

(12) United States Patent
Hikai

(10) Patent No.: US 6,843,032 B2
(45) Date of Patent: Jan. 18, 2005

(54) SIDING BOARDS ATTACHMENT STRUCTURE AND STARTER FITTING

(75) Inventor: Satoshi Hikai, Nagoya (JP)

(73) Assignee: Nichiha Co., Ltd., Nagoya (JP)

( * ) Notice: Subject to any disclaimer, the term of this patent is extended or adjusted under 35 U.S.C. 154(b) by 194 days.

(21) Appl. No.: 09/970,671

(22) Filed: Oct. 5, 2001

(65) Prior Publication Data

US 2002/0043029 A1 Apr. 18, 2002

(30) Foreign Application Priority Data

Oct. 12, 2000 (JP) ..... 2000-312346

(51) Int. Cl.[7] ..... E04B 2/00

(52) U.S. Cl. ..... 52/287.1; 52/712; 52/715; 52/543; 52/546; 52/547; 52/506.06

(58) Field of Search ..... 52/287.1, 712, 52/715, 543, 235, 546, 547, 489.1, 506.06, 506.09

(56) References Cited

U.S. PATENT DOCUMENTS

| | | | | | |
|---|---|---|---|---|---|
| D60,733 | S | * | 3/1922 | Murnane, Jr. | D25/121 |
| 4,288,958 | A | * | 9/1981 | Chalmers et al. | 52/478 |
| 4,999,961 | A | * | 3/1991 | McNary | 52/287.1 |
| 5,218,793 | A | * | 6/1993 | Ball | 52/62 |
| 5,542,222 | A | * | 8/1996 | Wilson et al. | 52/287.1 |
| 5,974,748 | A | * | 11/1999 | Sciuga et al. | 52/287.1 |
| 6,513,298 | B2 | * | 2/2003 | Rassel | 52/633 |
| 6,598,362 | B2 | * | 7/2003 | Hikai | 52/235 |
| 6,615,560 | B2 | * | 9/2003 | Ito | 52/506.06 |
| 2002/0020130 | A1 | * | 2/2002 | Hikai | 52/518 |

FOREIGN PATENT DOCUMENTS

| | | |
|---|---|---|
| JP | 5-26195 | 5/1993 |
| JP | 6-146536 | 5/1994 |
| JP | 6-054826 | 7/1994 |
| JP | 6-78467 | 11/1994 |
| JP | 9-88326 | 3/1997 |
| JP | 9-302889 | 11/1997 |
| JP | 10-061049 | 3/1998 |
| JP | 2575336 | 6/1998 |
| JP | 10-183940 | 7/1998 |
| JP | 3059696 | 4/2000 |
| JP | 2000-96803 | 4/2000 |
| JP | 2605547 | 5/2000 |
| JP | 2001-123546 | 5/2001 |

* cited by examiner

*Primary Examiner*—Marlo Slack
*Assistant Examiner*—Jennifer I. Thissell
(74) *Attorney, Agent, or Firm*—Oblon, Spivak, McClelland, Maier & Neustadt, P.C.

(57) ABSTRACT

The present invention provides a siding boards attachment structure having excellent ventilation characteristics and a high structural strength and a starter fitting used therewith. The siding boards attachment structure includes a starter fitting for supporting a siding board in the lowest portion, a ground sill flashing disposed in a lower portion of the siding board in the lowest portion, a furring strip for fixing the starter fitting, and the siding board supported by the starter fitting. The starter fitting includes a base plate portion having a planar rear side surface that is configured to be fixed to the furring strip, a supporting portion for supporting siding boards bent forward from the base plate portion, and spacing portions formed at left and right end portions of the base plate portion to have the cross sectional shape of a squarish letter U.

2 Claims, 12 Drawing Sheets

SIDING BOARDS ATTACHMENT STRUCTURE AND STARTER FITTING

CROSS-REFERENCES TO RELATED APPLICATIONS

The present application claims priority under 35 U.S.C. § 119 to Japanese Patent Application No. 2000-312346, filed Oct. 12, 2000, entitled "SIDING BOARDS ATTACHMENT STRUCTURE AND STARTER FITTING". The contents of this application are incorporated herein by reference in their entirety.

BACKGROUND OF THE INVENTION

1. Field of the Invention

The present invention relates to a siding boards attachment structure and a starter fitting.

2. Discussion of the Background

Conventionally, in a siding boards attachment structure, a starter fitting is used to support a siding board in the lowest portion. By way of example, FIG. 10 shows a siding boards attachment structure disclosed in Japanese Unexamined Patent Application Publication No. 10-159299. In this figure, a siding boards attachment structure 90 is constituted of a starter fitting 9, a ground sill flashing 3 disposed in a lower portion of a siding board 2 in a lowest portion, a furring strip 4 for fixing the starter fitting 9, and a siding board 2 supported by the starter fitting 9. The furring strip 4 is fixed to a column 51 of a building with a waterproof paper material 52 interposed between them.

The starter fitting 9 has a base plate portion 91 and a supporting portion 92. The base plate portion 91 fixes the furring strip 4. The supporting portion 92 is formed by bending the bottom 911 of the base plate portion 91 in an upper direction.

The ground sill flashing 3 has a fixing backside plate 31 and a flashing plate 33. The fixing backside plate 31 serves to fix the furring strip 4. The flashing plate 33 is bent forward and downward from a lower portion of the fixing backside plate 31.

In the siding boards attachment structure 90, the fixing backside plate 31 of the ground sill flashing 3 is fixed with a nail 62 to the furring strip 4. In addition, the base plate portion 91 of the starter fitting 9 is fixed with a nail 61 from the outside of the fixing backside plate 31.

The siding board 2 is attached in a manner that a lower overlying tongue portion 21 of the siding board 2 in the lowest portion is supported by the supporting portion 92 of the starter fitting 9 fixed to the furring strip 4.

However, in a portion where the starter fitting 9 is disposed in the siding boards attachment structure 90, only a very narrow gap can be formed between a rear side surface 22 of the siding board 2 and the furring strip 4, as shown in FIG. 10. Therefore, substantially no ventilation space is formed therebetween. Consequently, the restricted space is likely to cause corrosion and deterioration in the area of the furring strip 4 and the siding board 2.

By way of another conventional example, FIG. 11 shows a siding boards attachment structure 80. In the structure 80, a fixing backside plate 310 of a ground sill flashing 30 is fixed in an inner side of a furring strip 4, and a starter fitting 8 is fixed to an outer side of the furring strip 4.

In the siding boards attachment structure 80, the fixing backside plate 310 of the ground sill flashing 30 is disposed in a column 51 of a building. From the outside of the fixing backside plate 310, the furring strip 4 is fixed with a waterproof paper material 52 interposed between them. In addition, from the outside of the furring strip 4, the starter fitting 8 is fixed with a screw 63, and a siding board 2 is supported by the starter fitting 8. In this example, an ordinary fastening fitting is used for the starter fitting 8.

In addition, a flashing plate 330 of the ground sill flashing 30 is formed to extend up to a front portion of the siding board 2.

As shown in FIG. 11, the starter fitting 8 includes a base plate portion 81 and a supporting portion 82. The base plate portion 81 is formed to abut a rear side surface 22 of the siding board 2, and is fixed to the furring strip 4. The supporting portion 82 supports a lower overlying tongue portion 21 of the siding board 2. A sloped surface portion 83 bent rearward is formed on a top of the base plate portion 81. In addition, a leg portion 84 bent rearward is disposed at the bottom of the base plate portion 81.

Use of the starter fitting 8 enables the siding board 2 to be fitted at a portion spaced away from the furring strip 4, as shown in FIG. 11. Thus, in the siding boards attachment structure 80, a ventilation space 803 is formed between the rear side surface 22 of the siding board 2 and the furring strip 4.

However, in the siding boards attachment structure 80, unless the furring strip 4 is formed to extend downward at a sufficient length, a difficulty is caused in the fitting of the starter fitting 8 to the furring strip 4 to be stable. Thereby, the siding boards attachment structure 80 is likely to lack structural strength.

Specifically, as shown in FIG. 12, in a case where the furring strip 4 is so short that the starter fitting 8 needs to be fixed to overextend from a bottom 41, the leg portion 84 of the starter fitting 8 cannot be set to abut the furring strip 4. In this case, a difficulty is caused in the fitting of starter fitting 8 to the furring strip 4 to be stable, consequently making it difficult to attach the siding board 2 to be stable.

As a result, a case is likely to occur in which the siding boards attachment structure 80 lacks the structural strength sufficient to withstand pressure such as wind pressure.

SUMMARY OF THE INVENTION

An object of the present invention is to provide a siding boards attachment structure having excellent ventilation characteristics and a high structural strength.

Another object of the present invention is to provide a starter fitting that is used with the siding boards attachment structure.

According to the first aspect of the present invention, a siding boards attachment structure includes a starter fitting for supporting a siding board in the lowest portion, a ground sill flashing disposed in a lower portion of the siding board in the lowest portion, a furring strip for fixing the starter fitting, and the siding board supported by the starter fitting, wherein the starter fitting includes a base plate portion having a planar rear side surface that is fixed to the furring strip, a supporting portion for supporting siding boards bent forward from the base plate portion, and spacing portions formed at left and right end portions of the base plate portion to have the cross sectional shape of a squarish letter U.

The notable feature in this aspect of the invention is that the starter fitting includes the base plate portion having the planar rear side surface, and the spacing portions.

Hereinbelow, operational advantages of the siding boards attachment structure according to the present invention will be summarized.

The starter fitting has the base plate portion including the planar rear side surface. This allows the entirety of the base plate portion to be fixed to the furring strip. Thereby, the starter fitting can be fixed to the furring strip to be stable.

Even in the case where the furring strip is so short in the lower direction that the starter fitting needs to be fitted to overextend from the bottom of the furring strip, the planar rear side surface of the base plate portion can be closely fitted to the furring strip (refer to FIG. 6).

Thus, the siding boards attachment structure to be strong sufficiently to withstand wind pressure and the like can be obtained.

In addition, as described above, the starter fitting in the siding boards attachment structure includes the spacing portions. Therefore, by making an arrangement such that the rear side surface of the siding board abuts the spacing portions, the rear side surface of the siding board can be attached at a sufficient space from the furring strip. Consequently, a sufficiently large space, that is, the ventilation space, can be formed between the siding board and the furring strip.

The above space enables the ventilation characteristics to be secured for the siding boards attachment structure. Thereby, moisture can be prevented from being stored on the rear side surface of the siding board, the furring strip, and the like; and the resistance thereof can be improved.

In addition, the rear side surface of the siding board abuts the spacing portions provided at left and right sides of the starter fitting, thus the siding board is fixed to the furring strip stably.

As described above, the present invention provides the siding boards attachment structure that has excellent ventilation characteristics and a high structural strength.

According to the second aspect of the present invention, a starter fitting for supporting siding boards in lowest portions of a building, includes a base plate portion having a planar rear side surface that is configured to be fixed to a furring strip, a supporting portion for supporting siding boards bent forward from the base plate portion, and spacing portions formed at left and right end portions of the base plate portion to have the cross sectional shape of a squarish letter U.

As described above, the starter fitting has the base plate portion including the planar rear side surface. This allows the entirety of the base plate portion to be fixed to the furring strip. Thereby, the starter fitting can be fixed to the furring strip to be stable.

Even in the case where the furring strip is so short in the lower direction that the starter fitting needs to be fitted to overextend from the bottom of the furring strip, the planar rear side surface of the base plate portion can be closely fitted to the furring strip.

As described above, the starter fitting in the siding boards attachment structure includes the spacing portions. Therefore, by making an arrangement such that the rear side surface of the siding board abuts the spacing portions, a sufficiently large ventilation space can be formed between the siding board and the furring strip.

Thereby, the ventilation characteristics can be secured for the siding boards attachment structure, and the resistance thereof can be improved.

In addition, the starter fitting has spacing portions at its left and right sides, and the spacing portions abuts the rear side surface of the siding board, whereby the siding board can be fixed to the furring strip in a stable manner.

As described above, the present invention provides the starter fitting that has excellent ventilation characteristics and that enables the fabrication of the siding boards attachment structure having a high structural strength.

BRIEF DESCRIPTION OF THE DRAWINGS

A more complete appreciation of the invention and many of the attendant advantages thereof will become readily apparent with reference to the following detailed description, particularly when considered in conjunction with the companying drawings, in which.

DESCRIPTION OF THE PREFERRED EMBODIMENTS

Figure 7:
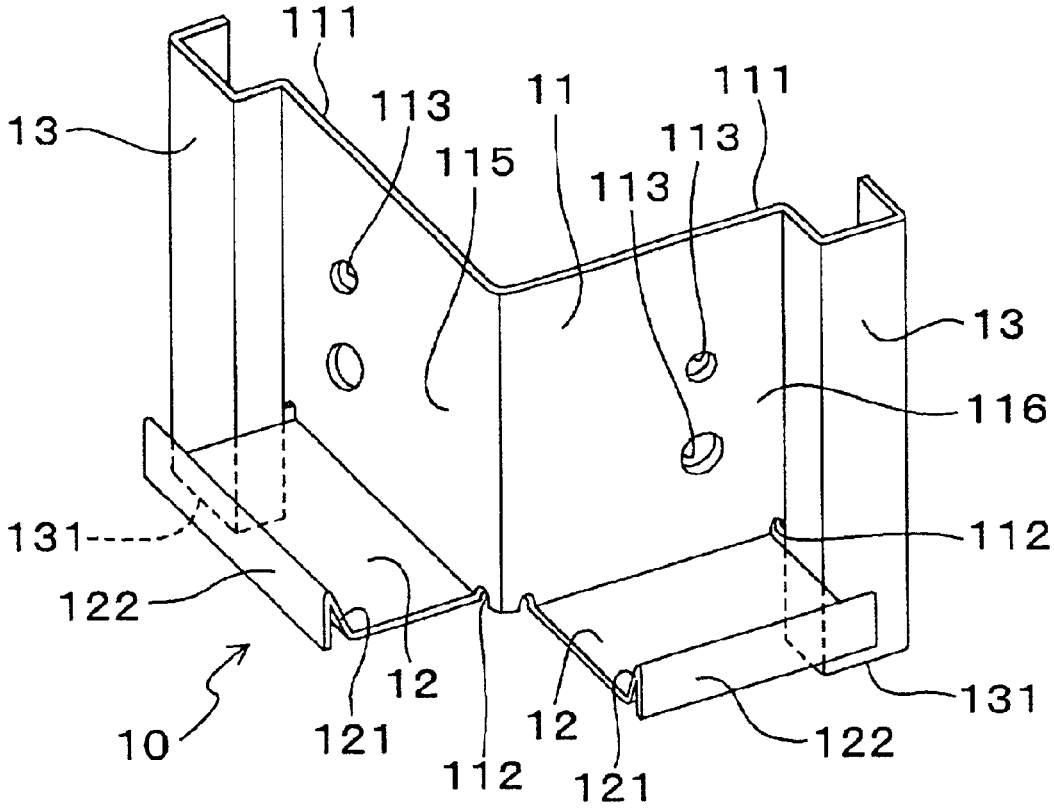
FIG. 7 is a perspective view of a starter fitting according to an embodiment 3 of the present invention.
Figure 8:
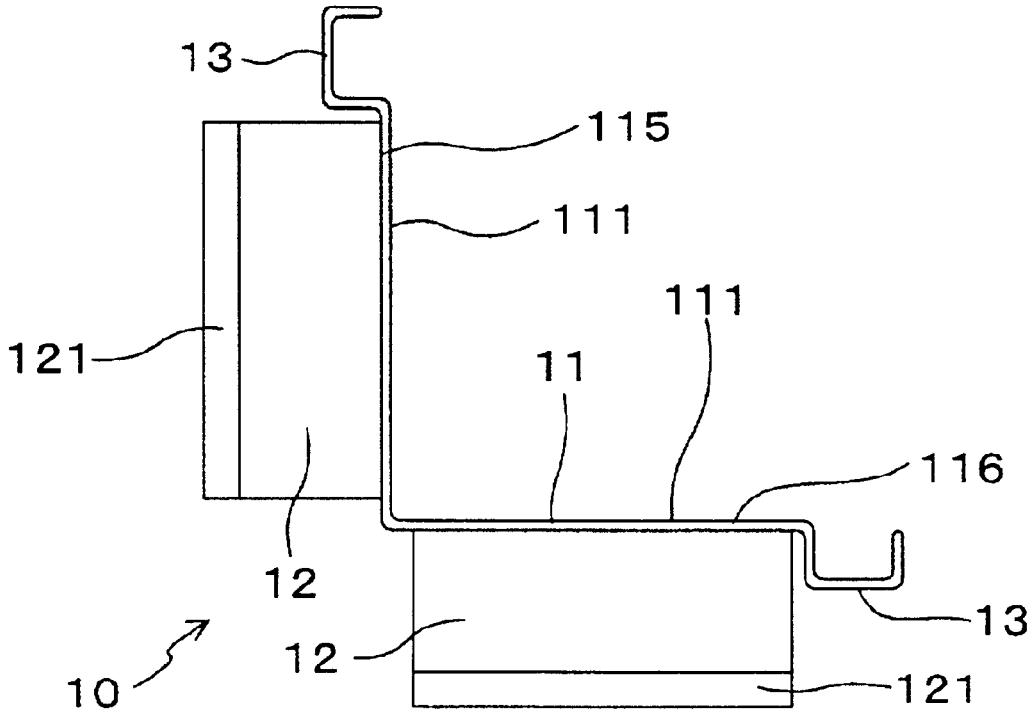
FIG. 8 is a plan view of the starter fitting according to the embodiment 3.
Figure 9:
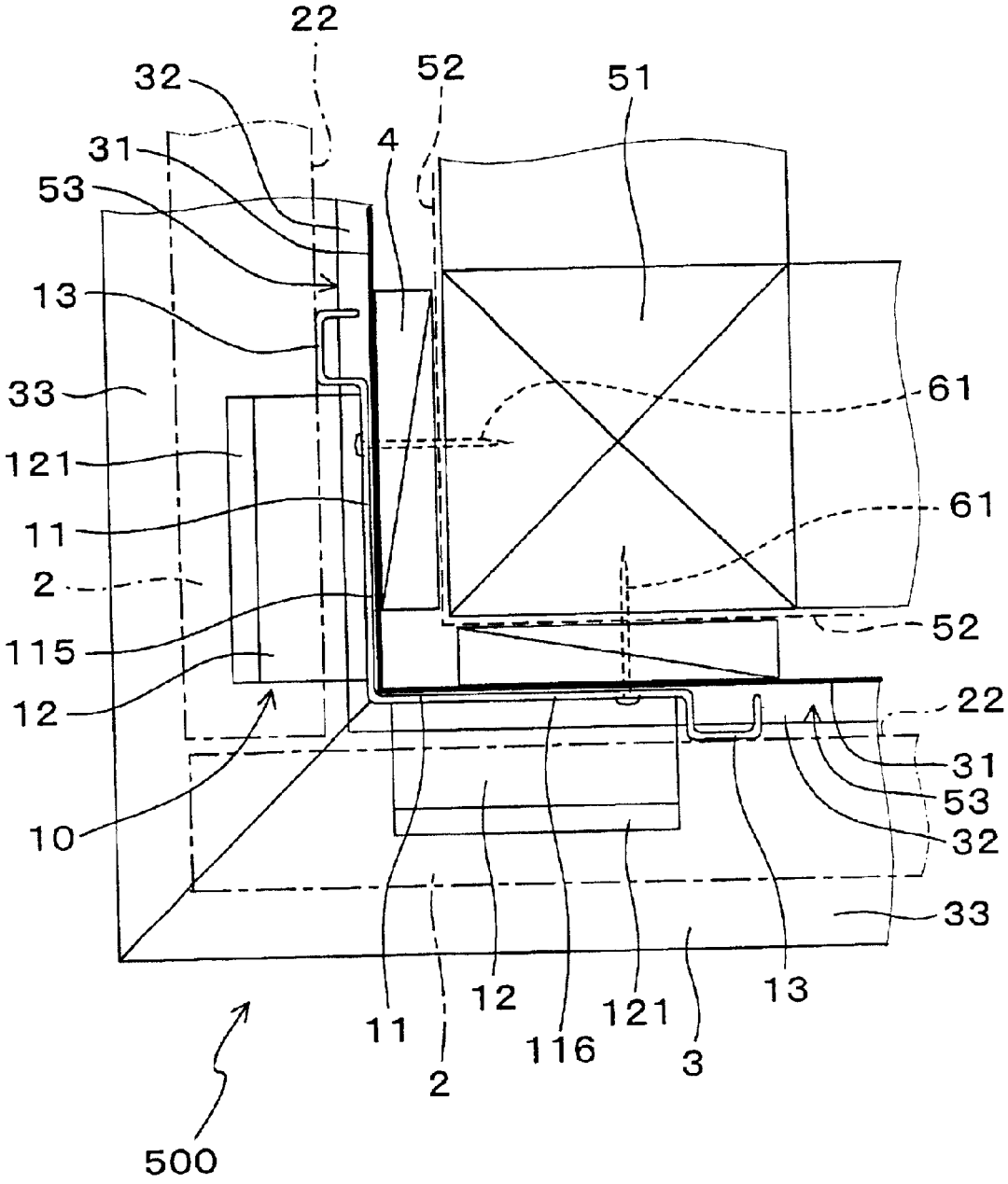
FIG. 9 is a horizontal cross sectional view of the siding boards attachment structure according to the embodiment 3.
Figure 10:
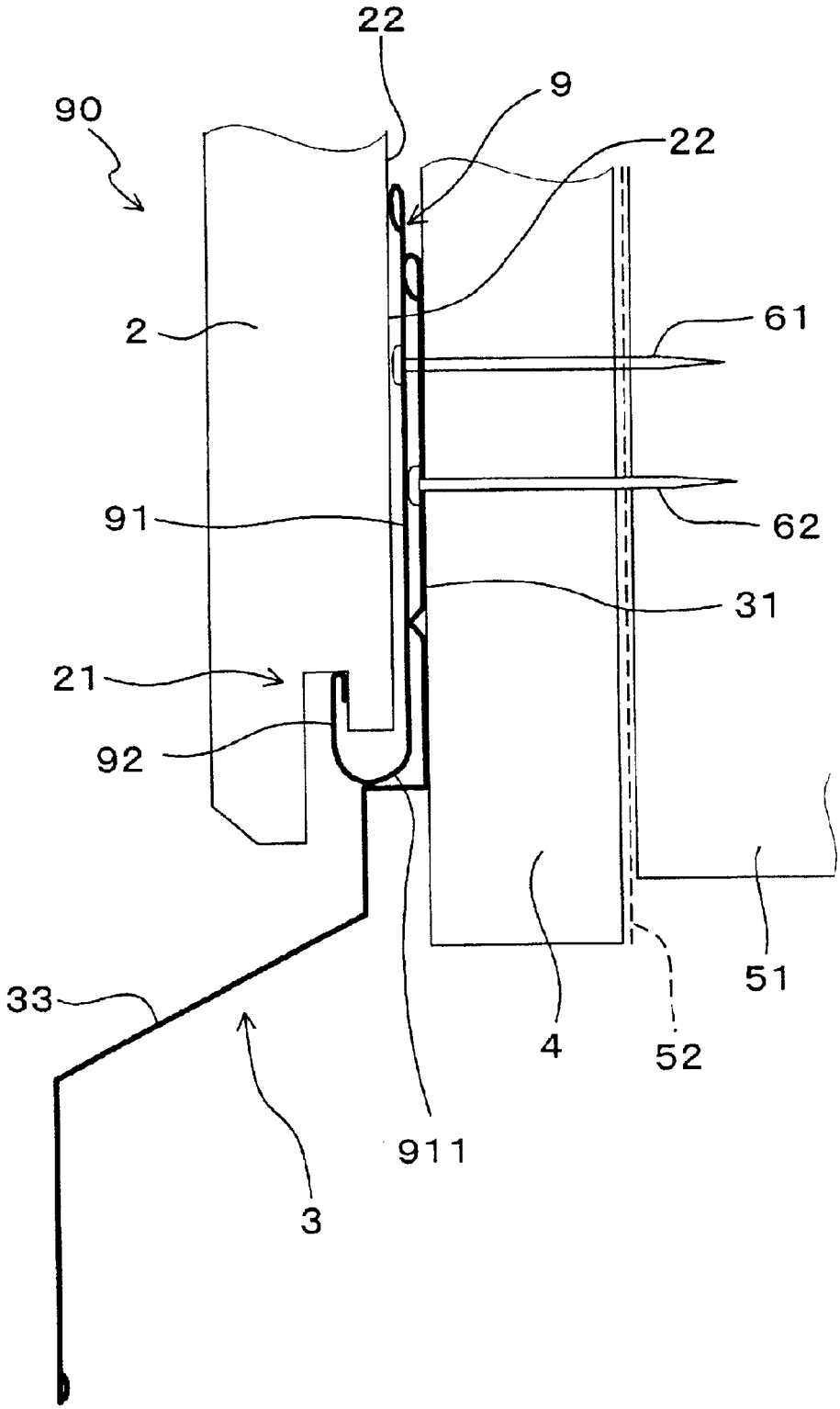
Fig.10 PRIOR ART
FIG. 10 is a vertical cross sectional view of an example of a conventional siding boards attachment structure.
Figure 11:
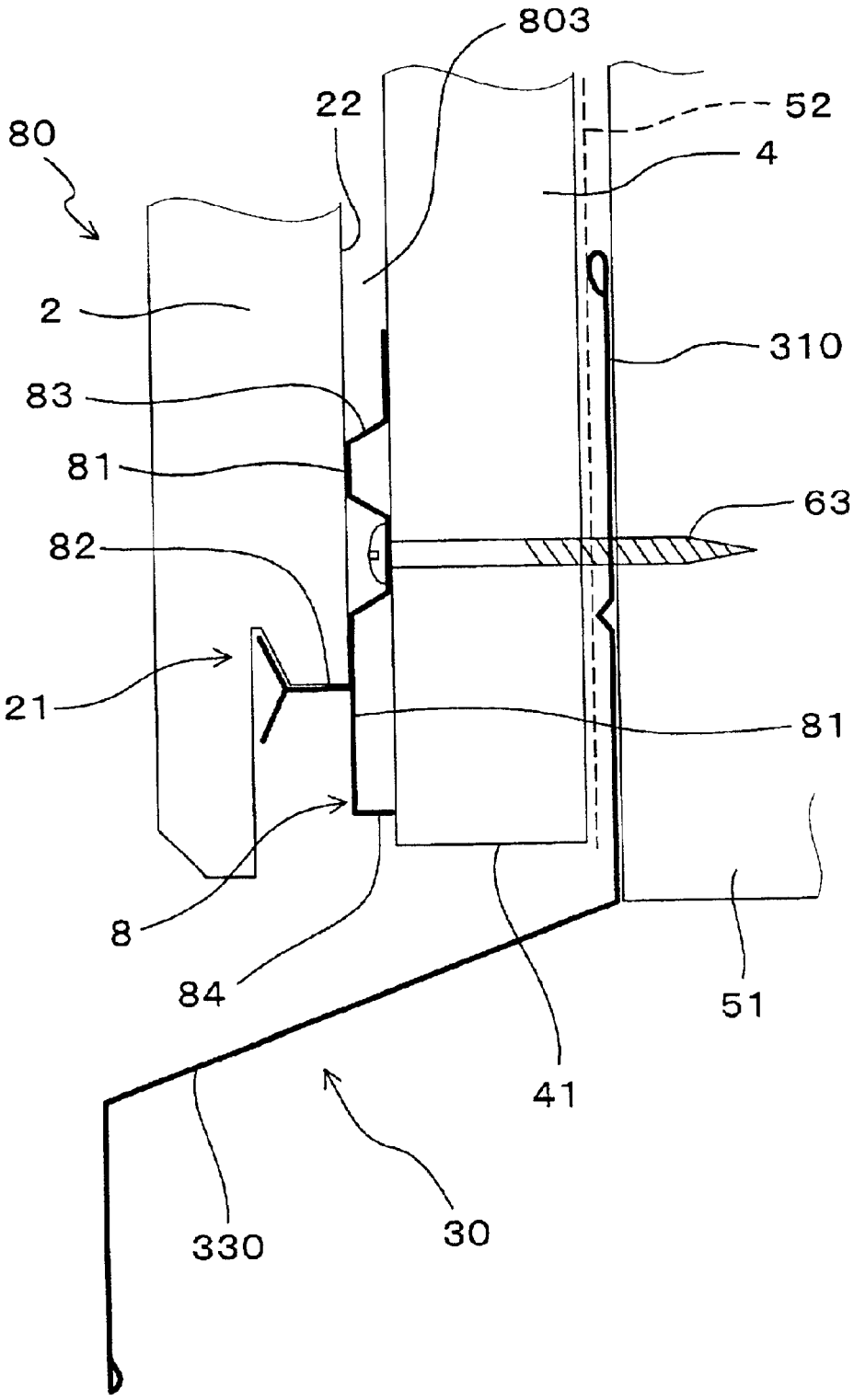
Fig.11 PRIOR ART
FIG. 11 is a vertical cross sectional view of another example of a conventional siding boards attachment structure.
Figure 12:
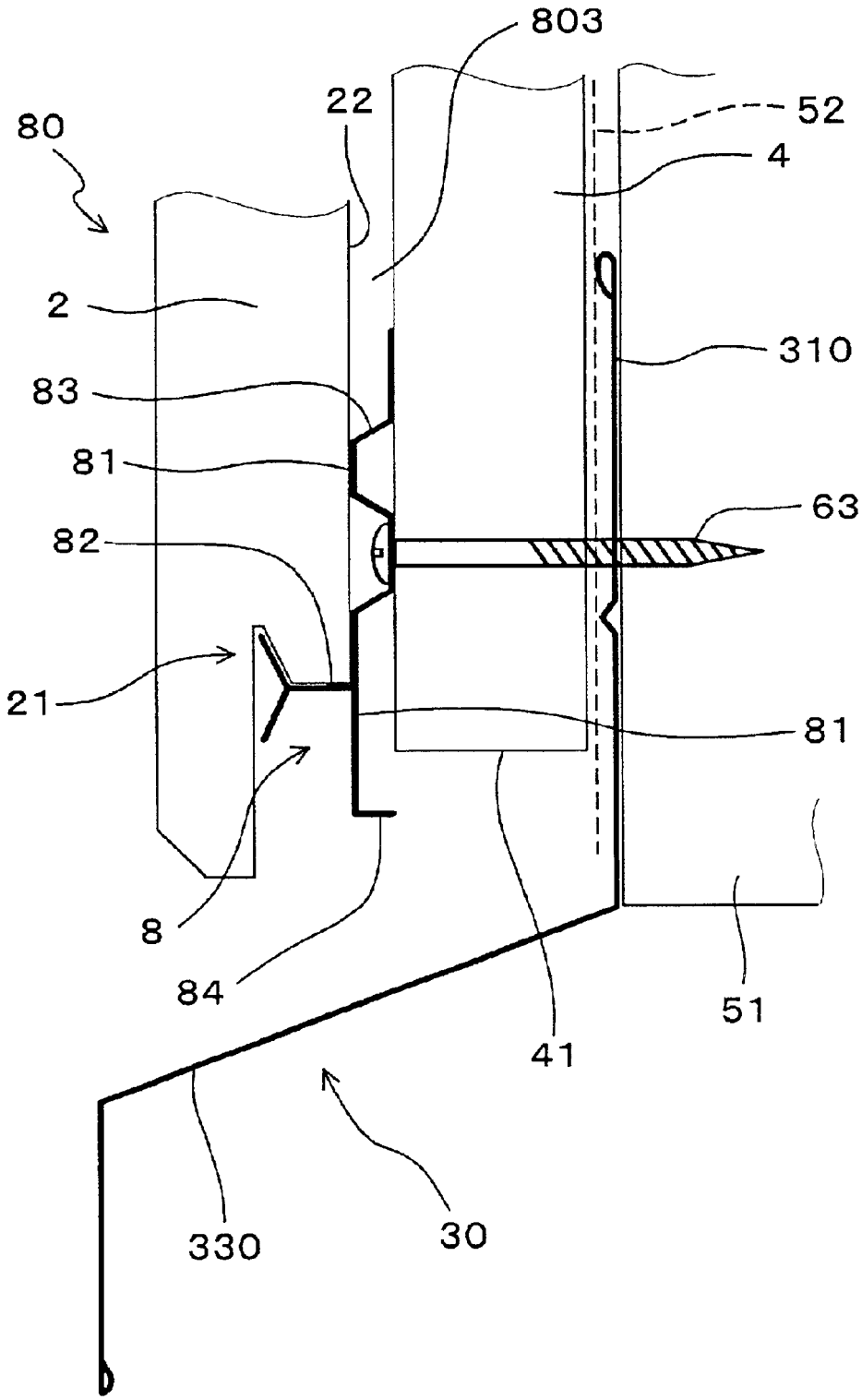
Fig.12 PRIOR ART
FIG. 12 is a vertical cross sectional view of still another example of a conventional siding boards attachment structure having a short furring strip.

In the first aspect of the present invention, it is preferable that the siding boards attachment structure is fabricated such that the starter fitting is disposed in a corner portion of a building, in the starter fitting for the corner portion, the base plate portion includes a first corner base plate and a second corner base plate which are substantially perpendicular to each other between the spacing portions formed at the left and right end portions of the base plate portion, and the supporting portion is formed for each of the first corner base plate and the second corner base plate (refer to FIGS. 7 to 9).

In this case, the siding boards attachment structure having excellent ventilation characteristics and a high structural strength can be obtained especially for the corner portion of the building.

It is preferable that each of the spacing portions has substantially the same thickness as at least a spaced distance between the siding board and the furring strip.

Thereby, the sufficiently large ventilation space can be securely formed between the siding board and the furring strip.

It is preferable that the supporting portion of the starter fitting includes an engaging end portion formed by bending the end of the supporting portion slantly upward.

Thereby, the starter fitting can more securely support the siding board existing in the lowest portion. Thus, the siding boards attachment structure having an even higher structural strength can be obtained.

It is preferable that a bottom of each of the spacing portions extends lower than the position of the supporting portion.

Thereby, the siding board can be attached to be even more stable.

Figure 1:
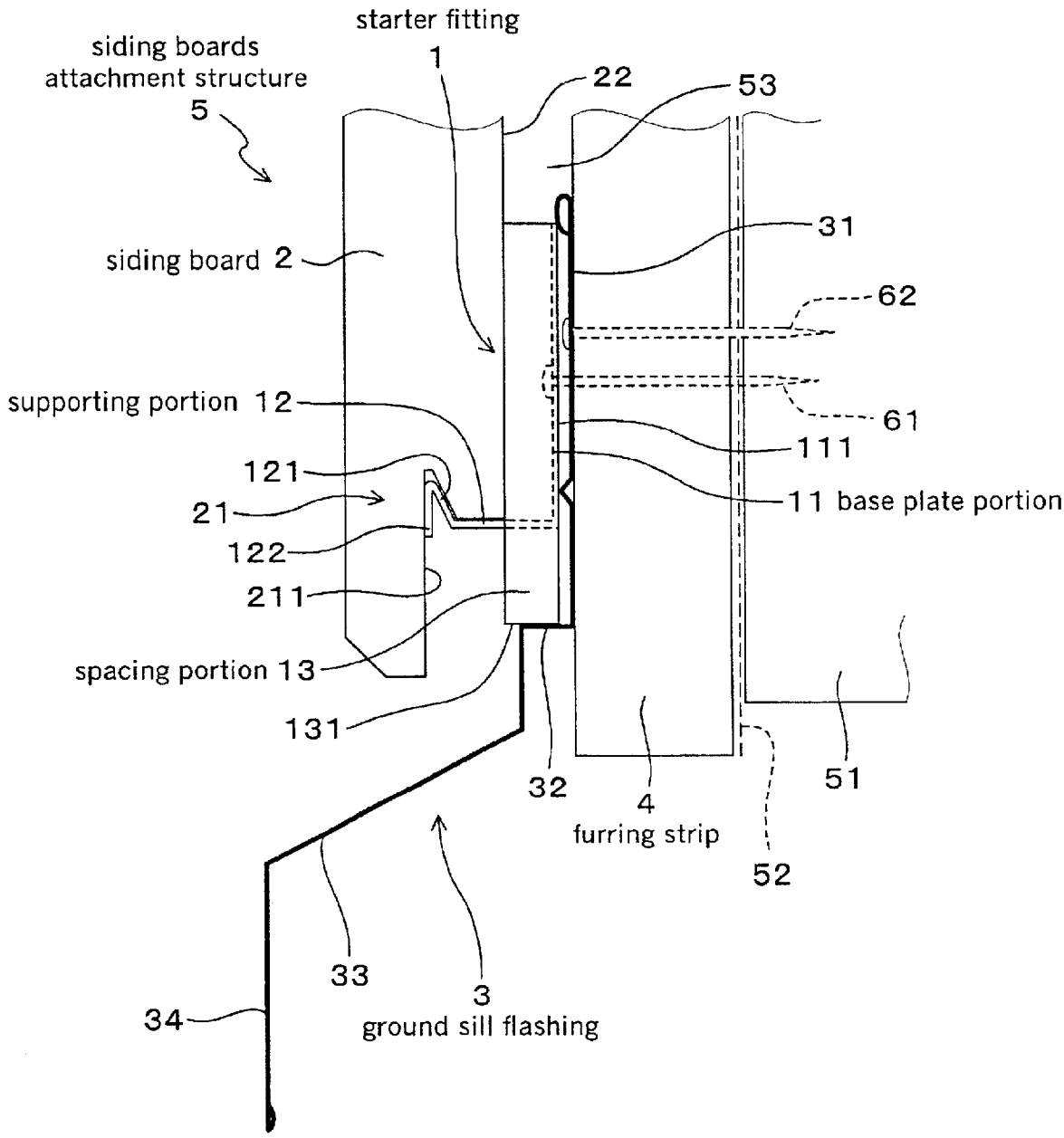
FIG. 1 is a vertical cross sectional view of a siding boards attachment structure according to an embodiment 1 of the present invention.

It is preferable that the starter fitting and the ground sill flashing are individually fixed to the furring strip (refer to FIG. 1).

Also in this case, the siding boards attachment structure having excellent ventilation characteristics and a high structural strength can be obtained.

It is preferable that the ground sill flashing have a step portion used for positional matching for a bottom of the starter fitting and that the bottom of the starter fitting abut the step portion.

Thereby, the starter fitting can easily be fixed in a correct position.

It is preferable that the starter fitting is fixed to the furring strip and that the ground sill flashing is fixed to a column at a position inwardly closer than the position of the furring strip. (refer to FIG. 5) Also in this case, the siding boards attachment structure having excellent ventilation characteristics and a high structural strength can be obtained.

In the second aspect of the present invention, it is preferable that the starter fitting is structured such that the starter fitting is configured to be disposed in a corner portion of the building, the starter fitting for the corner portion includes a first corner base plate and a second corner base plate which are substantially perpendicular to each other between the spacing portions formed at the left and right end portions of the base plate portion, and the supporting portion is formed for each of the first corner base plate and the second corner base plate.

In this case, particularly in the corner portion of the building, the siding boards attachment structure having excellent ventilation characteristics and a high structural strength can be fabricated.

It is preferable that each of the supporting portions of the starter fitting includes an engaging end portion formed by bending the end of the supporting portion slantly upward.

Thereby, the starter fitting that more securely supports the siding board existing in the lowest portion can be obtained.

Furthermore, it is preferable that a bottom of each of the spacing portions extend lower than the position of supporting portion.

Thereby, the siding board can be attached to be more stable.

Embodiment 1

Figure 2:
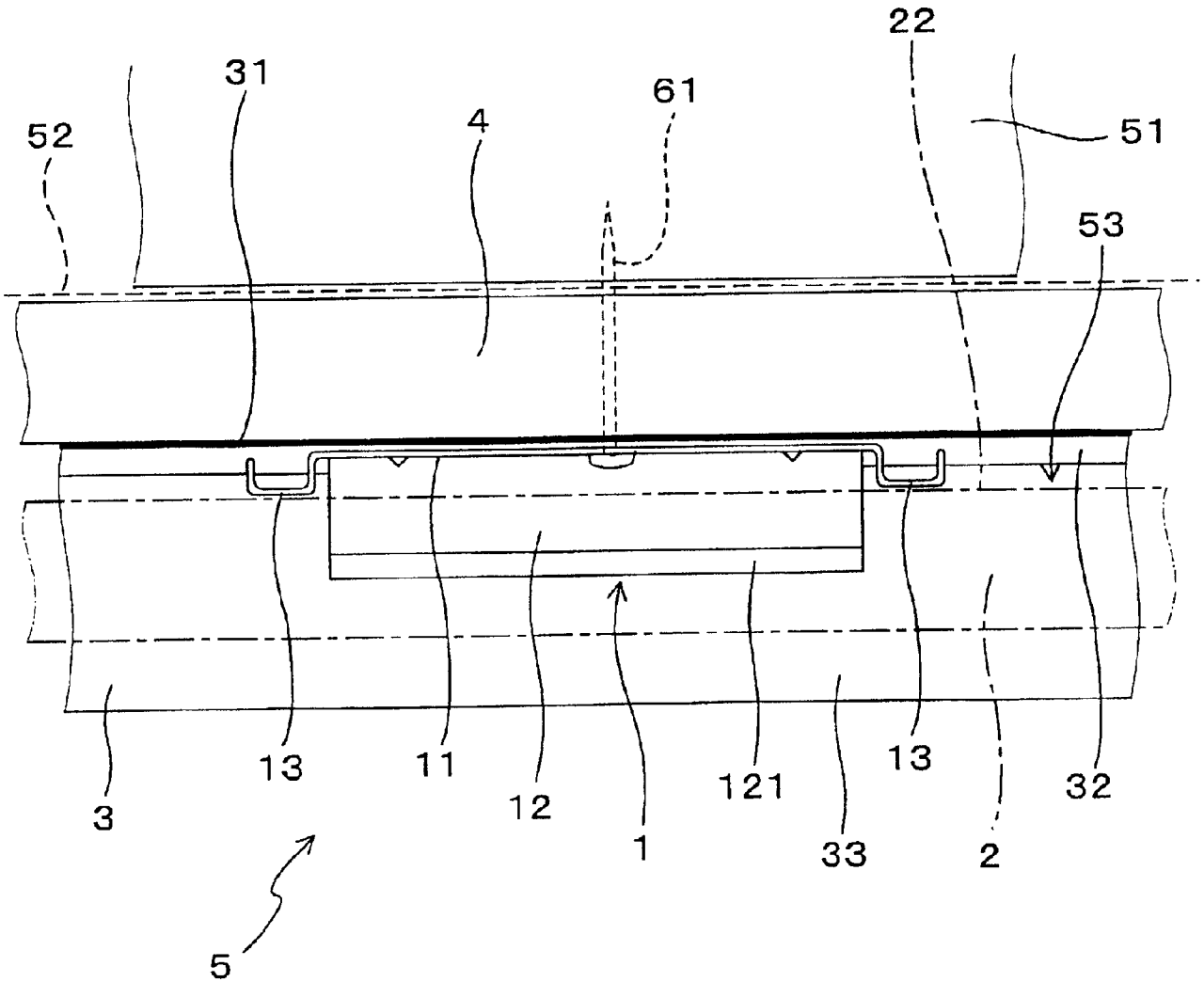
FIG. 2 is a horizontal cross sectional view of the siding boards attachment structure of the embodiment 1.
Figure 3:
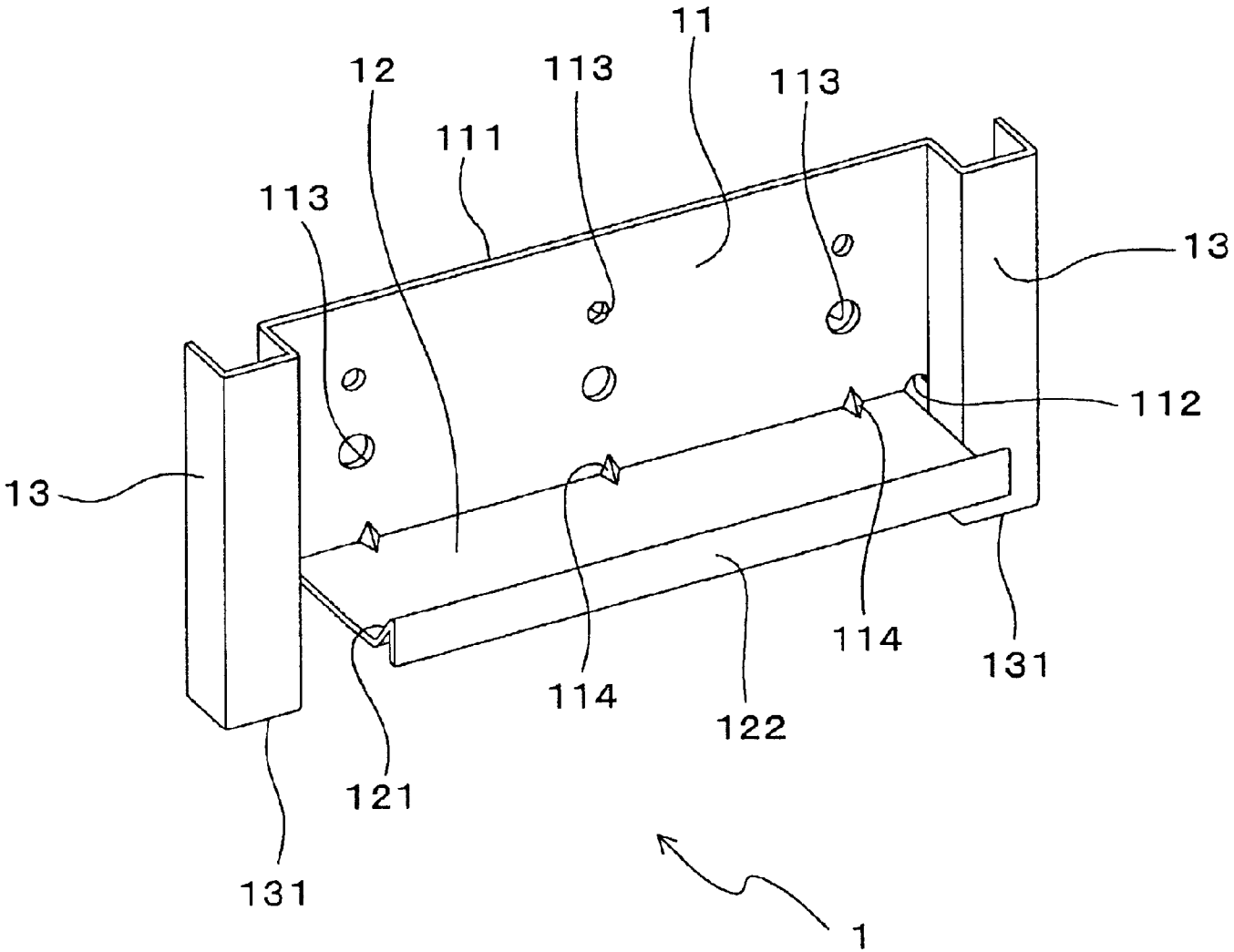
FIG. 3 is a perspective view of a starter fitting of the embodiment 1.
Figure 4A:
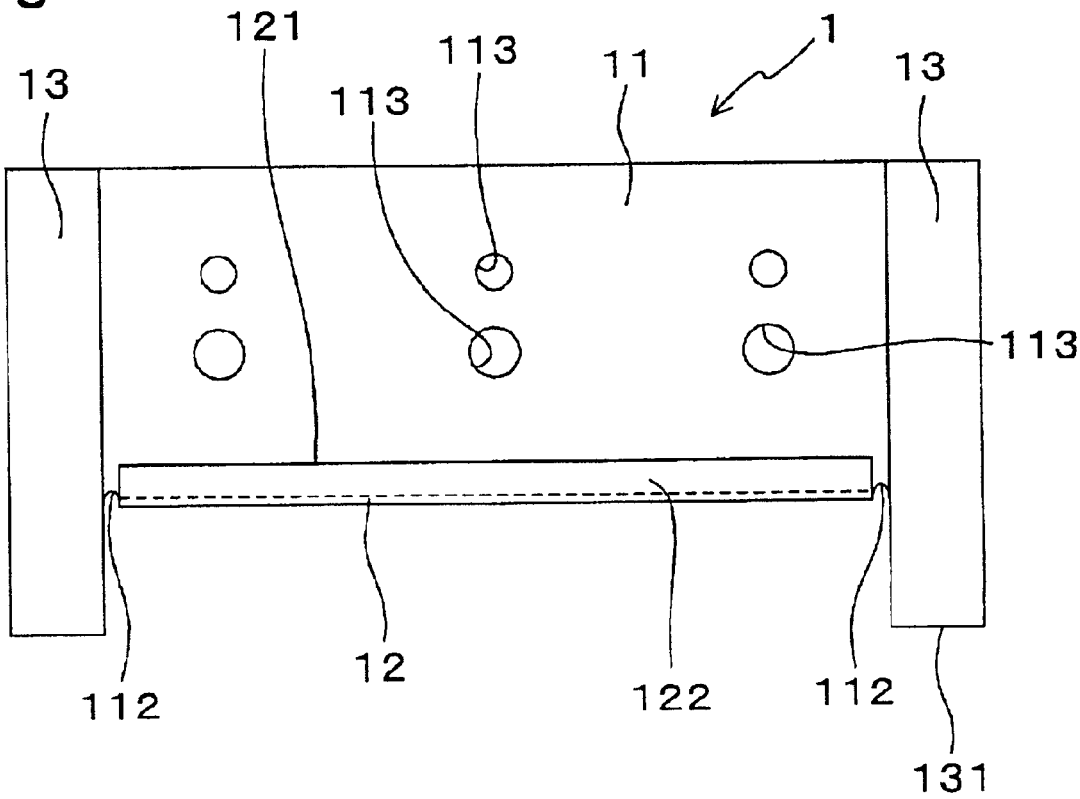
FIG. 4A is a front view the starter fitting of embodiment 1.

Hereinbelow, referring to FIGS. 1 to 4B, a description will be made regarding a siding boards attachment structure and a starter fitting according to an embodiment 1 of the present invention. FIG. 1 is a vertical cross sectional view of a siding boards attachment structure 5 of the embodiment 1; and FIG. 2 is a horizontal cross sectional view thereof. FIG. 3 is a perspective view of a starter fitting 1 of the present embodiment; FIG. 4A is a front view thereof; and FIG. 4B is a plan view thereof.

As shown in FIGS. 1 and 2, the siding boards attachment structure 5 includes the starter fitting 1, a ground sill flashing 3, a furring strip 4, and a siding board 2. The starter fitting 1 supports a siding board 2 provided in the lowest portion. The ground sill flashing 3 is disposed below the siding board 2 in the lowest portion. The furring strip 4 fixes the starter fitting 1. The siding board 2 is supported by the starter fitting 1.

Figure 4B:
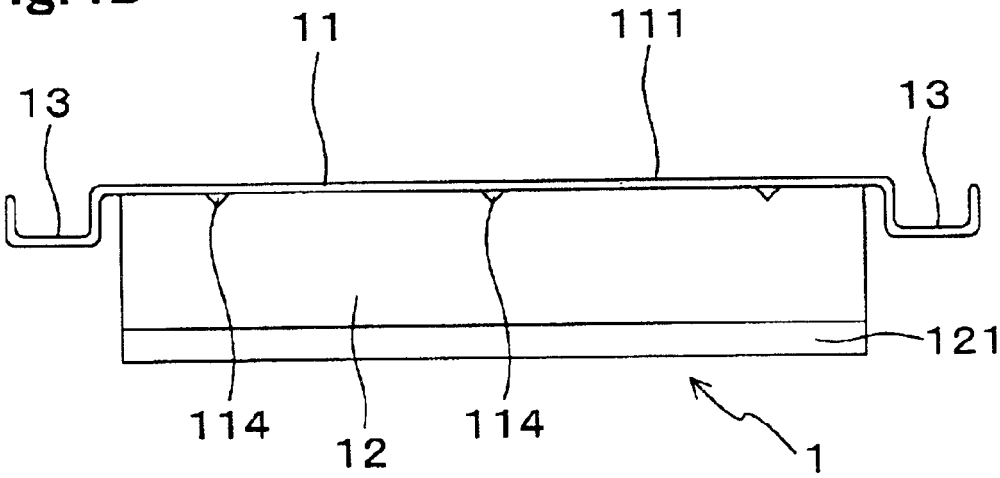
FIG. 4B is a plan view of the starter fitting of the embodiment 1.

As shown in FIGS. 3, 4A, and 4B, the starter fitting 1 includes a base plate portion 11, a supporting portion 12, and spacing portions 13. The base plate portion 11 includes a planar rear side surface 111 that is configured to be fixed to the furring strip 4. The supporting portion 12 is bent forward from the base plate portion 11 to support the siding board 2. The spacing portions 13 are each formed to have the cross sectional shape of a squarish letter U at both ends of the base plate portion 11.

As shown in FIGS. 1 and 2, the starter fitting 1 and the ground sill flashing 3 are fixed with nails 61 and 62, respectively, to the furring strip 4. The furring strip 4 is fixed to a column 51 of a building with a waterproof paper material 52 interposed between them.

The ground sill flashing 3 includes a fixing backside plate 31 to be fixed to the furring strip 4. The ground sill flashing 3 also includes a flashing plate 33. The flashing plate 33 has a lower portion bent forward and downward. A pendent plate 34 bent downward from the end of the flashing plate 33 is formed from the end of the flashing plate 33.

A step portion 32 is formed at the bottom of the fixing backside plate 31 to be bent in the front direction. The step portion 32 is used for positional matching for the bottom of the starter fitting 1. In the siding boards attachment structure 5, a bottom of the starter fitting 1, that is, a bottom 131 of the spacing portion 13, abuts the step portion 32.

As shown in FIGS. 1 and 3, the supporting portion 12 of the starter fitting 1 includes an engaging end portion 121 having an end portion bent slantly upward. From the upper end of the engaging end portion 121, a front plate portion 122 is formed to be bent downward.

As shown in FIG. 1, the engaging end portion 121 engages a lower overlying tongue portion 21 of the siding board 2, and the front plate portion 122 abuts a rear side surface 211 of the lower overlying tongue portion 21.

As shown in FIGS. 3 and 4A, each of the bottoms 131 of the spacing portions 13 of the starter fitting 1 extends lower than the position of the supporting portion 12. Each of the spacing portions 13 has substantially the same thickness as at least a spaced distance between the siding board 2 and the furring strip 4, that is, the thickness of a ventilation space 53 (shown in FIG. 1). Thus, the spacing portion 13 is formed to project forward from the base plate portion 11 by the distance equivalent to the thickness of the ventilation space 53 that will be formed.

In the starter fitting 1, a stainless plate is bent to be the supporting portion 12, and the spacing portions 13, and the like. Cutouts 112 for bending are individually formed beside two ends (left and right ends) of the supporting portion 12 in the base plate portion 11.

To improve the strength of the supporting portion 12, reinforcing concave portions 114 are formed in bent portions between the base plate portion 11 and the supporting portion 12.

In the base plate portion 11, two types (large and small) of through-holes 113 through which the nail 61 and a screw are inserted are formed.

Hereinbelow, a description will be made regarding operational advantages of the present embodiment.

As described above, the starter fitting 1 has the base plate portion 11 including the planar rear side surface 111. This allows the entirety of the base plate portion 11 to be fixed to the furring strip 4. Thereby, the starter fitting 1 can be fixed to the furring strip 4 to be stable.

Thus, the siding boards attachment structure 5 that is sufficiently strong to withstand wind pressure and the like can be obtained.

Especially, the lateral size of the base plate portion 11 of the starter fitting 1 is larger than that of a starter fitting currently in use. Accordingly, area where the rear side surface 111 of the base plate portion 11 faces the furring strip 4 is large, thereby increasing fixing force of starter fitting 1 to the furring strip 4.

As described above, the starter fitting 1 includes the spacing portions 13. Therefore, by making an arrangement such that the rear side surface 22 of the siding board 2 abuts the spacing portions 13, the rear side surface 22 of the siding board 2 can be attached at a sufficient space from the furring strip 4. Consequently, a sufficiently large space, that is, the ventilation space 53, can be formed between the siding board 2 and the furring strip 4.

The space allows the ventilation characteristics to be secured for the siding boards attachment structure 5. Thereby, moisture can be prevented from being stored on the rear side surface 22 of the siding board 2, the furring strip 4, and the like; and the resistance thereof can be improved.

Each of the spacing portions 13 of the starter fitting 1 has substantially the same thickness as at least the spaced distance between the siding board 2 and the furring strip 4. Therefore, the sufficiently large ventilation space 53 can be securely formed between the siding board 2 and the furring strip 4.

The left and right spacing portions 13 abut the rear side surface 22 of the siding board 2, whereby the siding board 2 can be fixed to the furring strip 4 to be stable.

The supporting portion 12 of the starter fitting 1 includes the engaging end portion 121. Thereby, the starter fitting 1 is enabled to support the siding board 2 even more securely.

The bottoms 131 of the spacing portions 13 extends lower than the position of the supporting portion 12. Thereby, the siding board 2 can be attached even more stable.

The ground sill flashing 3 has the step portion 32 that abuts the bottom of the starter fitting 1, that is, the bottoms 131 of the spacing portion 13. Thereby, the starter fitting 1 can be easily fixed at the correct position.

As described above, the siding boards attachment structure and the starter fitting 1 having excellent ventilation characteristics and a high structural strength can be obtained according to the embodiment 1.

Even in the case that the starter fitting 1 is directly fixed to the column 51 without the furring strip 4, ventilation between the column 51 and the siding board 2 can be secured, whereby durability of the column 51 is improved.

Embodiment 2

Figure 5:
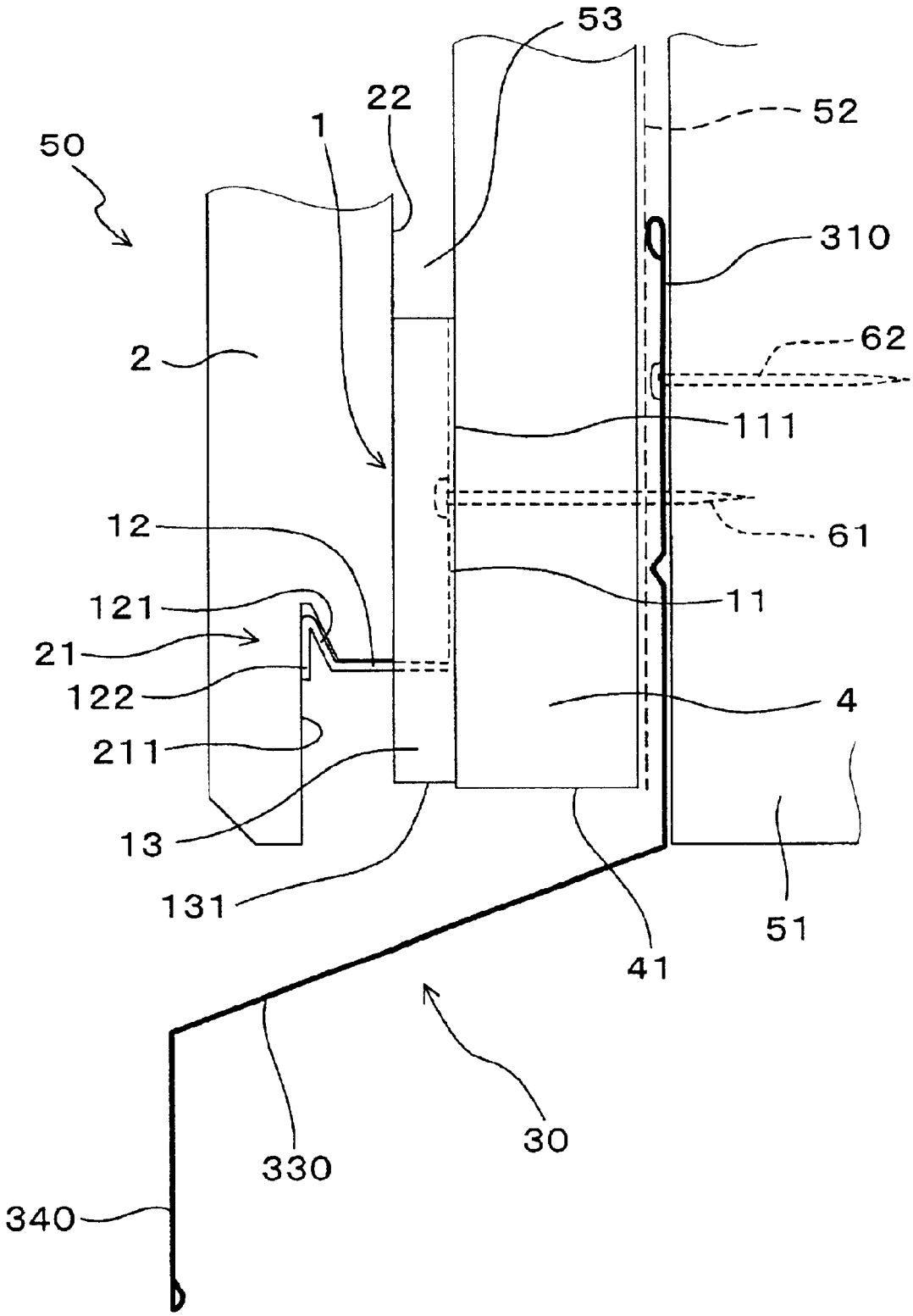
FIG. 5 is a vertical cross sectional view of a siding boards attachment structure according to an embodiment 2 of the present invention.
Figure 6:
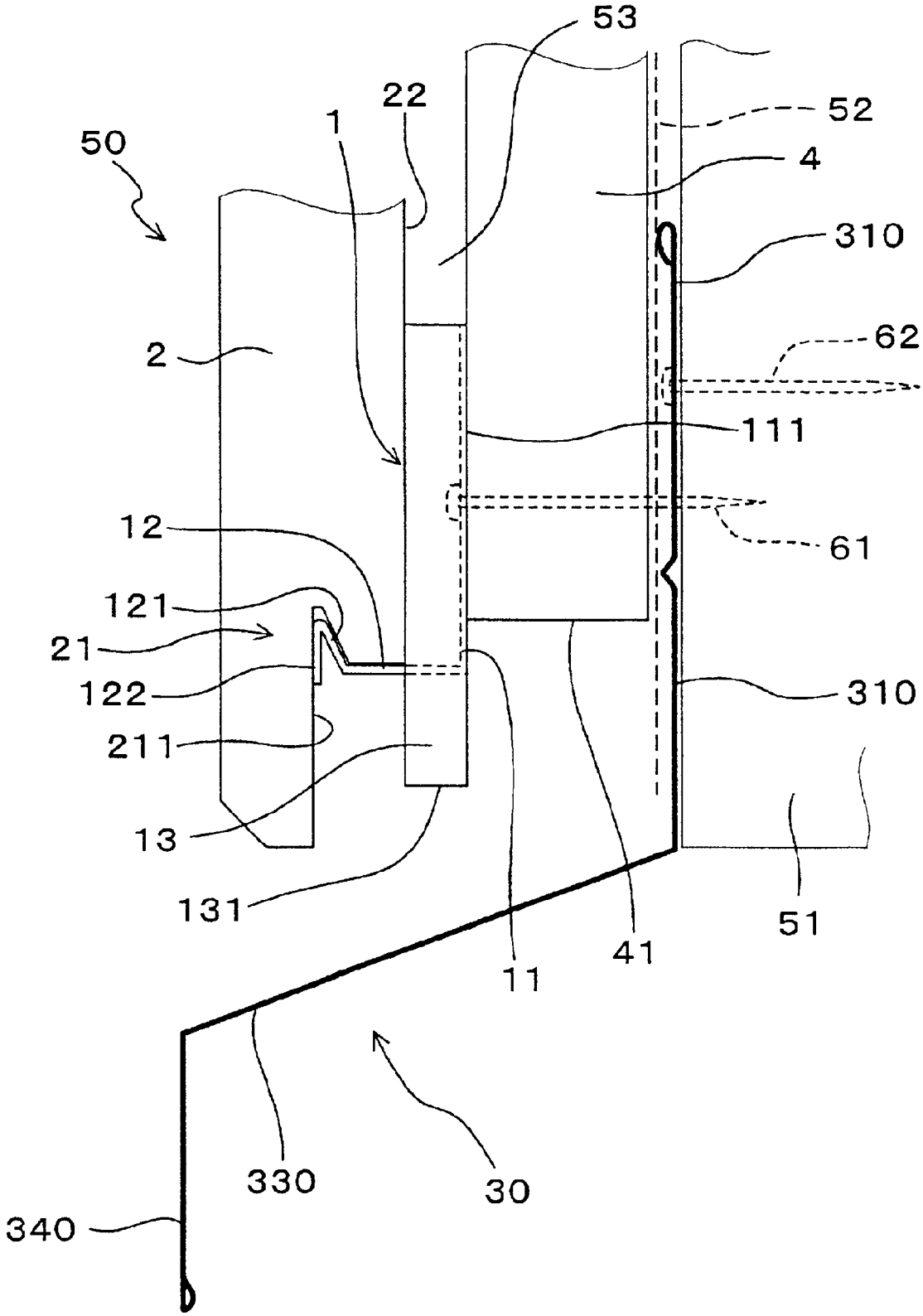
FIG. 6 is a vertical cross sectional view of the embodiment 2 of the siding boards attachment structure having a short furring strip.

By way of another exemplifying embodiment, a description will be made regarding an embodiment 2 of a siding boards attachment structure 50. As shown in FIGS. 5 and 6, in the siding boards attachment structure 50, a starter fitting 1 is fixed to a furring strip 4, and a ground sill flashing 30 is fixed to a column 51 in a position inwardly closer than the position of a furring strip 4.

The starter fitting 1 is structured similar in structure to the embodiment 1. The ground sill flashing 30 is formed of a fixing backside plate 310, a flashing plate 330, and a pendent plate 340.

In the siding boards attachment structure 50, the fixing backside plate 310 of the ground sill flashing 30 is fixed by using a nail 62 to the column 51. From the outside of the fixing backside plate 310, the furring strip 4 is fixed with a waterproof paper material 52 interposed between them. A base plate portion 11 of the starter fitting 1 is closely fixed to the furring strip 4 by using a nail 61.

Others are similar to those of the embodiment 1.

Also in the above-described case, similarly to the case of the embodiment 1, the siding boards attachment structure 50 having excellent ventilation characteristics and a high structural strength can be obtained.

In addition, as shown in FIG. 6, even in the case where the furring strip 4 is so short in the lower direction that the starter fitting 1 needs to be fitted to overextend from a bottom 41 of the furring strip 4, a planar rear side surface 111 of the base plate portion 11 can be closely fitted to the furring strip 4.

Accordingly, the starter fitting 1 can be fixed to the furring strip 4 to be stable. Consequently, even with the furring strip 4 that is short in the lower direction (FIG. 6), the siding boards attachment structure 50 having a high structural strength can be obtained.

Other operational advantages similar to those of the embodiment 1 can be obtained.

Embodiment 3

By way of another exemplifying embodiment, a description will be made regarding an embodiment 3 of a siding boards attachment structure 500. As shown in FIGS. 7 to 9, in the siding boards attachment structure 500, a starter fitting 10 disposed at a corner portion of a building is used.

FIG. 7 is a perspective view of the starter fitting 10, and FIG. 8 is a plan view thereof. FIG. 9 is a horizontal cross sectional view of the siding boards attachment structure 500.

As shown in FIGS. 7 and 8, in the starter fitting 10 for a corner, a base plate portion 11 is formed to have a first corner base plate 115 and a second corner base plate 116 bent substantially perpendicularly to each other between left and right spacing portions 13. Supporting portions 12 are individually formed for the first corner base plate 115 and the second corner base plate 116.

As shown in FIG. 9, in the siding boards attachment structure 500, furring strips 4 are individually fixed to two outer surfaces of the column 51 of the corner portion of the building with a waterproof paper material 52 interposed between them. A fixing backside plate 31 of a ground sill flashing 3 is fixed in the outside of the furring strips 4, and from the outside thereof, the starter fitting 10 is fitted to the furring strips 4 with nails 61.

Others are similar to those of the embodiment 1.

In this case, especially for the corner portion of the building, the siding boards attachment structure 500 having excellent ventilation characteristics and a high structural strength can be obtained.

Other operational advantages are similar to those of the embodiment 1.

Obviously, numerous modifications and variations of the present invention are possible in light of the above teachings. It is therefore to be understood that, within the scope of the appended claims, the invention may be practiced otherwise than as specifically described here.

What is claimed is:

1. A siding boards attachment structure comprising:

a lowest siding board for a corner portion of a building;

a starter fitting disposed in a lowest portion of said corner portion of said building, said starter fitting configured to support the lowest siding board in the lowest portion;

a ground sill flashing disposed adjacent a lower portion of the lowest siding board;

a furring strip for fixing said starter fitting; and the lowest siding board supported by said starter fitting, wherein said starter fitting comprises:

a base plate portion having a planar rear side surface that is fixed to said furring strip, said base plate portion comprising a first corner base plate and a second corner base plate, said first corner base plate and said second corner base plate being formed substantially perpendicular to each other between spacing portions formed at left and right end portions of said base plate portion, said spacing portions having a cross sectional shape of a squarish letter U, each of said spacing portions having a depth, said depth substantially equal to at least a spaced distance between said siding board and said furring strip; and supporting portions for supporting siding boards bent forward from said base plate portion, each of said first corner base plate and said second corner base plate having at least one of said supporting portions, each of said supporting portions respectively comprising engaging end portions formed by bending the end portions of said supporting portions upwardly, each of said supporting portions and said respective end portions forming an angle therebetween that slants upwardly.

2. A siding boards attachment structure according to claim 1, wherein a bottom of each of said spacing portions extends lower than the position of said supporting portion.

* * * * *